US008284126B2

(12) United States Patent
Kwon

(10) Patent No.: US 8,284,126 B2
(45) Date of Patent: Oct. 9, 2012

(54) ORGANIC LIGHT EMITTING DISPLAY AND DRIVING METHOD THEREOF

(75) Inventor: Oh-Kyong Kwon, Seoul (KR)

(73) Assignee: Samsung Mobile Display Co., Ltd, Gyeonggi-Do (KR)

( * ) Notice: Subject to any disclaimer, the term of this patent is extended or adjusted under 35 U.S.C. 154(b) by 830 days.

(21) Appl. No.: 12/080,956

(22) Filed: Apr. 8, 2008

(65) Prior Publication Data

US 2008/0252569 A1 Oct. 16, 2008

(30) Foreign Application Priority Data

Apr. 10, 2007 (KR) ..... 10-2007-0035009

(51) Int. Cl.
*G09G 3/30* (2006.01)

(52) U.S. Cl. ..... 345/76; 315/169.3

(58) Field of Classification Search ..... 345/76, 345/36, 45; 315/169.3
See application file for complete search history.

(56) References Cited

U.S. PATENT DOCUMENTS

| | | | | |
|---|---|---|---|---|
| 6,911,781 | B2 * | 6/2005 | Yamazaki et al. | 315/169.3 |
| 7,456,812 | B2 * | 11/2008 | Smith et al. | 345/82 |
| 2005/0179625 | A1 * | 8/2005 | Choi et al. | 345/76 |
| 2006/0139264 | A1 | 6/2006 | Choi et al. | |
| 2007/0018917 | A1 | 1/2007 | Miyazawa | |
| 2008/0001854 | A1 * | 1/2008 | Hamer et al. | 345/76 |
| 2008/0036703 | A1 | 2/2008 | Wang et al. | |
| 2008/0122759 | A1 * | 5/2008 | Levey | 345/78 |
| 2008/0224962 | A1 | 9/2008 | Kasai et al. | |
| 2008/0252571 | A1 | 10/2008 | Hente et al. | |

FOREIGN PATENT DOCUMENTS

| | | | |
|---|---|---|---|
| JP | 2004-145257 | A | 5/2004 |
| JP | 2005-128272 | A | 5/2005 |
| JP | 2005-258427 | A | 9/2005 |
| JP | 2005-309230 | A | 11/2005 |
| JP | 2006-058352 | A | 3/2006 |
| JP | 2006-058352 | A | 4/2006 |
| JP | 2007-052202 | A | 3/2007 |
| JP | 2007-140325 | A | 6/2007 |
| KR | 10-2005-0049320 | A | 5/2005 |
| KR | 10-2005-0052332 | A | 6/2005 |
| KR | 10-2006-0029062 | A | 4/2006 |
| KR | 10-2006-0112993 | A | 11/2006 |
| KR | 10-2006-0112995 | A | 11/2006 |
| KR | 10-2006-0132795 | A | 12/2006 |
| KR | 10-2007-0000422 | A | 1/2007 |

(Continued)

OTHER PUBLICATIONS

Notice of Allowance issued by the Korean Patent Office on Jun. 26, 2008 for KR 10-2007-0035009.

(Continued)

*Primary Examiner* — Kevin M Nguyen
*Assistant Examiner* — Kenneth B Lee, Jr.
(74) *Attorney, Agent, or Firm* — Knobbe Martens Olson & Bear LLP

(57) ABSTRACT

An organic light emitting display capable of displaying an image with uniform luminance regardless of deterioration of an organic light emitting diode and threshold voltage and/or mobility of a drive transistor is disclosed. The organic light emitting display senses deterioration of the organic light emitting diode and threshold voltage and/or mobility of a drive transistor and modifies the data supplied to the pixel according to the sensed parameters.

18 Claims, 6 Drawing Sheets

FOREIGN PATENT DOCUMENTS

KR 10-2007-0019882 A 2/2007

OTHER PUBLICATIONS

Korean Office Action dated Aug. 29, 2008 for Korean Patent Applications No. KR 10-2007-0028166 corresponding to U.S. Appl. No. 12/077,828, filed Mar. 21, 2008, which is related to the captioned application.

Korean Notice of Allowance dated Jun. 26, 2008 for Korean Patent Applications No. KR 10-2007-0035012 corresponding to U.S. Appl. No. 12/080,955, filed Apr. 8, 2008, which is related to the captioned application.

Korean Office Action dated Aug. 29, 2008 for Korean Patent Application No. KR 10-2007-0035011 corresponding to U.S. Appl. No. 12/082,147, filed Apr. 8, 2008, which is related to the captioned application.

Office Action dated Aug. 4, 2011 for U.S. Appl. No. 12/082,147, filed Apr. 8, 2008, which is related to captioned U.S. Appl. No. 12/080,956.

Office Action dated Aug. 10, 2011 for U.S. Appl. No. 12/077,828, filed Mar. 21, 2008, which is related to captioned U.S. Appl. No. 12/080,956.

Office Action dated Aug. 10, 2011 for U.S. Appl. No. 12/080,955, filed Apr. 8, 2008, which is related to captioned U.S. Appl. No. 12/080,956.

Office Action dated Mar. 28, 2012 for U.S. Appl. No. 12/077,828, filed Mar. 21, 2008, which is related to captioned U.S. Appl. No. 12/080,956.

Office Action dated Apr. 25, 2012 for U.S. Appl. No. 12/080,955, filed Apr. 8, 2008, which is related to captioned U.S. Appl. No. 12/080,956.

* cited by examiner

ORGANIC LIGHT EMITTING DISPLAY AND DRIVING METHOD THEREOF

CROSS-REFERENCE TO RELATED APPLICATIONS

This application claims the benefit of Korean Patent Application No. 10-2007-0035009, filed on Apr. 10, 2007, in the Korean Intellectual Property Office, the disclosure of which is incorporated herein by reference.

BACKGROUND

1. Field

The field relates to an organic light emitting display and a driving method thereof, and more particularly to an organic light emitting display capable of displaying an image with uniform luminance regardless of deterioration of an organic light emitting diode and threshold voltage or mobility of a drive transistor, and a driving method thereof.

2. Discussion of Related Technology

In recent years, a variety of flat panel displays of reduced weight and volume when compared to a cathode ray tube have been developed and commercialized. A flat panel display may take the form of a liquid crystal display (LCD), a field emission display (FED), a plasma display panel (PDP), an organic light emitting display (OLED, etc.

Among the flat panel displays, the organic light emitting display uses an organic light emitting diode to display an image, the organic light emitting diode generating the light by means of the recombination of electrons and holes. Such an organic light emitting display has an advantage that it has a rapid response time and also it is driven with low power consumption.

SUMMARY OF CERTAIN INVENTIVE ASPECTS

One aspect is an organic light emitting display, including a plurality of pixels, each arranged near intersections of data lines, scan lines, power lines and light emitting control lines, a scan driver configured to supply a scan signal to the scan lines and to supply a light emitting control signal to the light emitting control lines, a control line driver configured to supply a first control signal to first control lines and to supply a second control signal to second control lines, a data driver configured to generate a data signal for the data lines, and a sensing unit configured to sense information about at least one of an organic light emitting diode, a threshold voltage of a drive transistor, and mobility of the drive transistor for one or more of the pixels. The display also includes a switching unit configured to couple one of the sensing unit and the first power source with the power lines, a control block configured to store the sensed information, and a timing controller configured to generate the second data based on the sensed information and a first data received from another circuit.

Another aspect is a method of driving an organic light emitting display, the method including generating a first voltage while supplying an electric current to a drive transistor and an organic light emitting diode, converting the first voltage into a first digital value, and storing the first digital value in a memory. The method also includes generating a second voltage while supplying an electric current to the organic light emitting diode, converting the second voltage into a second digital value, storing the second digital value in the memory, and converting a first data supplied from another circuit to a second data based on the first digital value and the second digital value.

BRIEF DESCRIPTION OF THE DRAWINGS

These and/or other embodiments and features will become apparent and more readily appreciated from the following description, taken in conjunction with the accompanying drawings of which.

DETAILED DESCRIPTION OF CERTAIN INVENTIVE EMBODIMENTS

Figure 1:
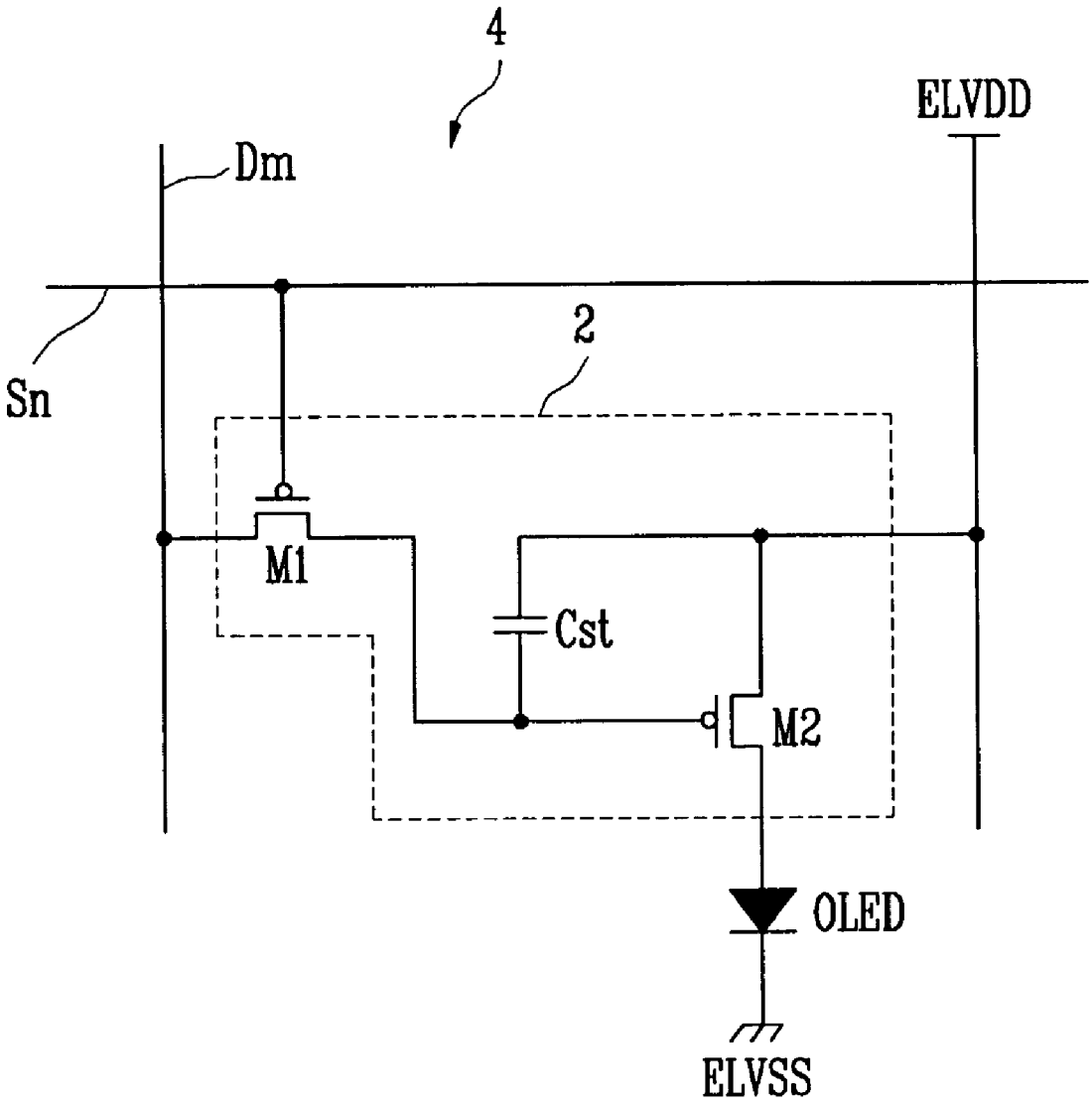
FIG. 1 (PRIOR ART)
FIG. 1 is a circuit view showing pixels of a conventional organic light emitting display.

Hereinafter, certain exemplary embodiments will be described with reference to the accompanying drawings. Here, when a first element is described as being coupled to a second element, the first element may be not only directly coupled to the second element but may alternatively be indirectly coupled to the second element via a third element. Further, elements that are not essential to the complete understanding of the invention may be omitted for clarity. Also, like reference numerals generally refer to like elements throughout.

FIG. 1 is a circuit view showing a pixel of a conventional organic light emitting display.

Referring to FIG. 1, the pixel 4 includes an organic light emitting diode (OLED), data lines (Dm) and a pixel circuit 2 coupled to the scan lines (Sn) to control the organic light emitting diode (OLED).

An anode electrode of the organic light emitting diode (OLED) is coupled to the pixel circuit 2, and a cathode electrode is coupled to the second power source (ELVSS). Such an organic light emitting diode (OLED) generates a predetermined luminance to correspond to an electric current supplied from the pixel circuit 2.

The pixel circuit 2 controls an electric current supplied to the organic light emitting diode (OLED) to correspond to a data signal supplied to the data lines (Dm) when a scan signal is supplied to the scan lines (Sn). For this purpose, the pixel circuit 2 includes a second transistor (M2) coupled between the first power source (ELVDD) and the organic light emitting diode (OLED); a first transistor (M1) coupled between the second transistor (M2) and the data lines (Dm) and the scan lines (Sn); and a storage capacitor (Cst) coupled between a gate electrode and a first electrode of the second transistor (M2).

A gate electrode of the first transistor (M1) is coupled to the scan lines (Sn), and a first electrode is coupled to the data lines (Dm). And, a second electrode of the first transistor (M1) is coupled to one side terminal of the storage capacitor (Cst). Here, the first electrode is either a source electrode or a drain electrode, and the second electrode is the electrode which is different from the first electrode. For example, if the first electrode is a source electrode, then the second electrode is a drain electrode. When a scan signal is supplied from the scan lines (Sn), the first transistor (M1) coupled to the scan lines (Sn) and the data lines (Dm) is turned on to supply the data signal from the data lines (Dm) to the storage capacitor (Cst). As a result, the storage capacitor (Cst) charges a voltage corresponding to the data signal.

The gate electrode of the second transistor (M2) is coupled to one terminal of the storage capacitor (Cst), and the first electrode is coupled to the other terminal of the storage capacitor (Cst) and to the first power source (ELVDD). The second electrode of the second transistor (M2) is coupled to the anode electrode of the organic light emitting diode (OLED). The second transistor (M2) controls the electric current so as to correspond to the voltage stored in the storage capacitor (Cst), the electric current flowing from the first power source (ELVDD) to the second power source (ELVSS) through the organic light emitting diode (OLED). In response, the organic light emitting diode (OLED) generates the light according to the amount of electric current supplied from the second transistor (M2).

However, an organic light emitting display having a pixel such as that of FIG. 1 has a disadvantage that it is difficult to display an image having a desired luminance due to the changes in current caused by the deterioration of the organic light emitting diode (OLED). The organic light emitting diode deteriorates with the passage of time, and therefore, because the organic light emitting diode receives substantially the same amount of current, the light emitted by the OLED gradually reduces luminance over time. Also, the conventional organic light emitting display has a problem that it does not display an image having a uniform luminance due to non-uniformity in the threshold voltage and/or mobility of the drive transistors (M2) in each of the pixels 4.

Figure 2:
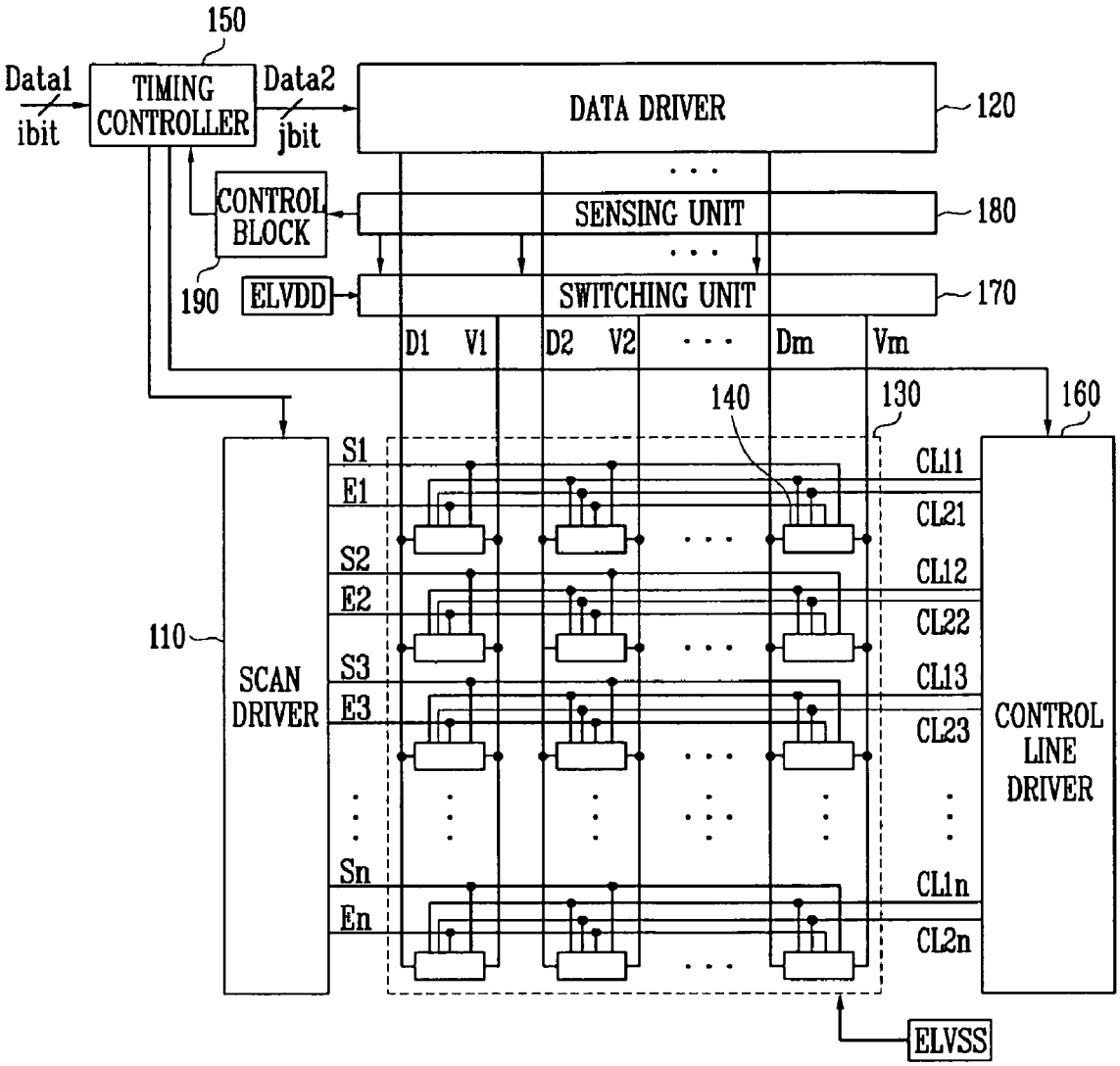
FIG. 2 is a block diagram showing an organic light emitting display according to one embodiment.

FIG. 2 is a diagram showing an organic light emitting display according to one embodiment.

Referring to FIG. 2, an organic light emitting display includes pixels 140 coupled to scan lines (S1 to Sn), light emitting control lines (E1 to En) and data lines (D1 to Dm); a scan driver 110 for driving the scan lines (S1 to Sn) and the light emitting control lines (E1 to En); a control line driver 160 for driving the first control lines (CL11 to CL1n) and the second control lines (CL21 to CL2n); a data driver 120 for driving the data lines (D1 to Dm); and a timing controller 150 for controlling the scan driver 110, the data driver 120 and the control line driver 160.

Also, the organic light emitting display according to one embodiment of the present invention further includes a sensing unit 180 for extracting the information about the deterioration of the organic light emitting diode and the threshold voltage/mobility of the drive transistor, the organic light emitting diode and the drive transistor being included in each of the pixels 140; a switching unit 170 for selectively coupling the sensing unit 180 and the first power source (ELVDD) to the power lines (V1 to Vm); and a control block 190 for storing the information sensed in the sensing unit 180.

The pixel unit 130 includes pixels 140 arranged near intersecting points of the scan lines (S1 to Sn), the light emitting control lines (E1 to En), the power lines (V1 to Vm) and the data lines (D1 to Dm). The pixels 140 charge a voltage according to the data signal and supply an electric current, corresponding to the charged voltage, to the organic light emitting diode, thereby generating light having a desired luminance.

The scan driver 110 sequentially supplies a scan signal to the scan lines (S1 to Sn) according to the control of the timing controller 150. Also, the scan driver 110 supplies a light emitting control signal the light emitting control lines (E1 to En) according to the timing controller 150.

The control line driver 160 supplies a first control signal to the first control lines (CL11 to CL1n) and a second control signal of the second control lines (CL21 to CL2n) according to the control of the timing controller 150.

The data driver 120 supplies a data signal to the data lines (D1 to Dm) according to the control of the timing controller 150.

The switching unit 170 selectively couples the sensing unit 180 and the first power source (ELVDD) to the power lines (V1 to Vm). For this purpose, the switching unit 170 includes at least one switching element coupled to each of the power lines (V1 to Vm).

The sensing unit 180 extracts information about the deterioration of the organic light emitting diode and the threshold voltage and/or mobility of the drive transistor in each of the pixels 140; and supplies the extracted information to a control block 190. The sensing unit 180 includes an electric current source unit coupled to each of the power lines (V1 to Vm).

The control block 190 stores the information about the deterioration of the organic light emitting diode and the threshold voltage and/or mobility of the drive transistor, the organic light emitting diodes and the drive transistors in each of the pixels 140. For this purpose, the control block 190 includes a memory; and a controller for transmitting the information, stored in the memory, to the timing controller 150.

The timing controller 150 controls the data driver 120, the scan driver 110 and the control line driver 160. Also, the timing controller 150 converts a bit value of a first data (Data1), received from another circuit, according to the information supplied from the control block 190, to generate a second data (Data2). Here, the first data (Data1) is set to i bits (i is a natural number), and the second data (Data2) is set to j bit (j is a natural number greater than i).

The second data (Data2) stored in the timing controller 150 is supplied to the data driver 120. The data driver 120 uses the second data (Data2) to generate a data signal, and supplies the generated data signal to the pixels 140.

Figure 3:
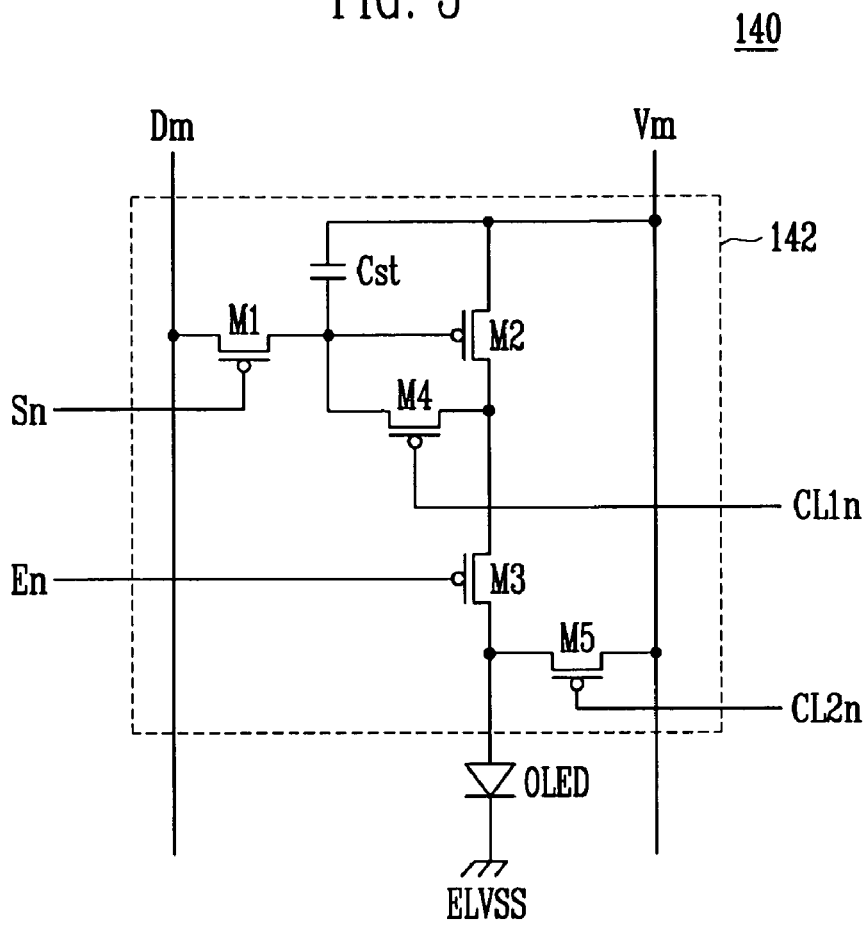
FIG. 3 is a circuit diagram showing one embodiment of the pixels of FIG. 2.

FIG. 3 is a diagram showing one embodiment of the pixels shown in FIG. 2. In FIG. 3, the pixel shown is coupled to an $m^{th}$ data line (Dm) and an $n^{th}$ scan line (Sn).

Referring to FIG. 3, the pixel 140 includes an organic light emitting diode (OLED) and a pixel circuit 142 for supplying an electric current to the organic light emitting diode (OLED).

The anode electrode of the organic light emitting diode (OLED) is coupled to the pixel circuit 142, and the cathode electrode is coupled to the second power source (ELVSS). Such an organic light emitting diode (OLED) generates the light having a predetermined luminance to correspond to the electric current supplied from the pixel circuit 142.

The pixel circuit 142 receives the data signal supplied to the data line (Dm) when a scan signal is supplied to the scan line (Sn). The pixel circuit 142 supplies information about the threshold voltage and/or mobility of the drive transistor and the deterioration of the organic light emitting diode (OLED) to the sensing unit 180 when a first control signal is supplied to the first control line (CL1n). The pixel circuit 142 supplies information on the deterioration of the organic light emitting diode (OLED) to the sensing unit 180 when a control signal is supplied to the second control line (CL2n). For this purpose, the pixel circuit 142 includes five transistors (M1 to M5) and a storage capacitor (Cst).

A gate electrode of the first transistor (M1) is coupled to the scan line (Sn), and a first electrode is coupled to the data line (Dm). A second electrode of the first transistor (M1) is coupled to a first terminal of the storage capacitor (Cst). The first transistor (M1) is turned on when a scan signal is supplied to the scan line (Sn). Accordingly, the scan signal is supplied to store the data signal in the storage capacitor (Cst).

The gate electrode of the second transistor (M2) is coupled to a first terminal of the storage capacitor (Cst), and a first electrode is coupled to a second terminal and to power line (Vm) of the storage capacitor (Cst). The second transistor (M2) supplies electric current to the organic light emitting diode (OLED), the electric current corresponding to a voltage value stored in the storage capacitor (Cst) when the power line (Vm) is coupled to the first power source (ELVDD). Accordingly, the organic light emitting diode (OLED) generates light corresponding to an electric current supplied from the second transistor (M2).

The gate electrode of the third transistor (M3) is coupled to the light emitting control line (En), and a first electrode is coupled to a second electrode of the second transistor (M2). And, a second electrode of the third transistor (M3) is coupled to the organic light emitting diode (OLED). The third transistor (M3) is turned off when a light emitting control signal is supplied to the light emitting control line (En), and turned on when the light emitting control signal is not supplied to the light emitting control line (En). The light emitting control signal is supplied during periods when a voltage corresponding to the data signal is charged in the storage capacitor (Cst) and when the information about the deterioration of the organic light emitting diode (OLED) is sensed.

The gate electrode of the fourth transistor (M4) is coupled to the first control line (CL1n), and a first electrode is coupled to a second electrode of the second transistor (M2). Also, a second electrode of the fourth transistor (M4) is coupled to the gate electrode of the second transistor (M2). The fourth transistor (M4) is turned on when the first control signal is supplied, and then couples the second transistor (M2) in a diode configuration. The first control signal is supplied during a period when the information about the threshold voltage and/or mobility of the second transistor (M2) and the deterioration of the organic light emitting diode are sensed.

The gate electrode of the fifth transistor (M5) is coupled to the second control line (CL2n), and a first electrode is coupled to the power line (Vm). Also, a second electrode of the fifth transistor (M5) is coupled to an anode electrode of the organic light emitting diode (OLED). The fifth transistor (M5) is turned on when the second control signal is supplied. The second control signal is supplied when the information about the deterioration of the organic light emitting diode (OLED) is sensed.

Figure 4:
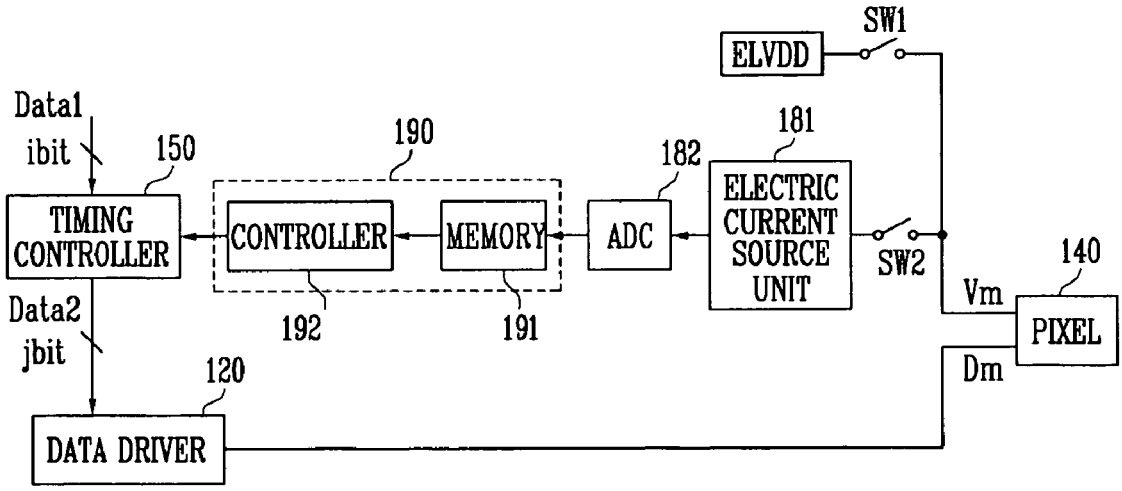
FIG. 4 is a block diagram showing a switching unit, a sensing unit and a control block shown in FIG. 2.

FIG. 4 is a block diagram showing a switching unit, a sensing unit and a control block as shown in FIG. 2. In FIG. 4, the switching unit, the sensing unit and the control block are coupled to an $m^{th}$ power line (Vm).

Referring to FIG. 4, each of the channels of the switching unit 170 includes two switching elements (SW1, SW2). And, each of the channels of the sensing unit 180 includes an electric current source unit 181 and an analog-digital converter (ADC) 182. One ADC may be shared by a plurality of channels, or one ADC may share all of the channels. The control block 190 includes a memory 191 and a controller 192.

The first switching element (SW1) is between the power line (Vm) and the first power source (ELVDD). The first switching element (SW1) is maintained in a turned-on state during a period when the light having a luminance corresponding to the data signal is generated in the pixel 140.

The second switching element (SW2) is between the electric current source unit 181 and the power line (Vm). The second switching element (SW2) is turned on when the information about the deterioration of the organic light emitting diode (OLED) and the threshold voltage and/or mobility of the second transistor (M2) are sensed.

The electric current source unit 181 supplies a constant electric current to the pixel 140 when the second switching element (SW2) is turned on, and applies a voltage to the ADC 182, the voltage being generated when the constant electric current is applied to the pixel. The electric current source unit 181 supplies a constant electric current to the second power source (ELVSS) via the second transistor (M2) and the organic light emitting diode (OLED). A first voltage corresponding to the threshold voltage and/or mobility of the second transistor (M2) and the deterioration of the organic light emitting diode (OLED) is generated in the electric current source unit 181, and the generated first voltage is applied to the ADC 182.

The electric current source unit 181 supplies a constant electric current to the second power source (ELVSS) via the organic light emitting diode (OLED). In addition, a second voltage corresponding to the deterioration of the organic light emitting diode (OLED) is generated in the electric current source unit 181, and the generated second voltage is also applied to the ADC 182.

The resistance of the organic light emitting diode (OLED) increases as the organic light emitting diode (OLED) ages. Accordingly, the voltage applied to the organic light emitting diode (OLED) may be used to determine a level of the aging or deterioration of the organic light emitting diode (OLED). Also, if the constant electric current is supplied via the second transistor (M2), a voltage is applied to the source electrode of the second transistor (M2). Since the voltage applied to the source electrode of the second transistor (M2) is determined based on the threshold voltage and/or mobility of the second transistor (M2) and the deterioration of the organic light emitting diode (OLED), the voltage and the second voltage applied to the source electrode of the second transistor (M2) may be used to determine threshold voltage and/or mobility of the second transistor (M2).

The electric current value of the constant electric current supplied to the pixel 140 is experimentally determined so that the information about the threshold voltage and/or mobility of the second transistor (M2) and the deterioration of the organic light emitting diode (OLED) can be extracted from the electric current source unit 181. For example, the constant electric current may be set to an electric current value that will be supplied to the organic light emitting diode (OLED) when the pixel 140 is allowed to emit the light with the highest luminance.

The ADC 182 converts the first voltage supplied to the electric current source unit 181 into a first digital value, and converts the second voltage into a second digital value.

The memory 191 stores the first digital value and the second digital value supplied to the ADC 182. The memory 191 stores the information about the threshold voltage and/or mobility of the second transistor (M2) and the deterioration of the organic light emitting diode (OLED) of each of the pixels 140 included in the pixel unit 130. For this purpose, the memory 191 may be a frame memory.

The controller 192 supplies the first digital value and the second digital value to the timing controller 150, wherein the first digital value and the second digital value are extracted from the pixel 140 to which a first data (Data1) will be supplied, the first data (Data1) being received from the timing controller 150.

The timing controller 150 receives a first data (Data1) e and receives the first digital value and the second digital value from the controller 192. After the timing controller 150 receives the first digital value and the second digital value, it converts a value of the first data (Data1) to generate a second data (Data2) so that it can display an image having a uniform luminance.

For example, the timing controller 150 generates a second data (Data2) with reference to the second digital value since the value of the first data (Data1) is increased as the organic light emitting diode (OLED) is more deteriorated. Accordingly, the second data (Data2) reflects the information about the deterioration of the organic light emitting diode (OLED), and therefore the timing controller 150 prevents the emitted light from having a lower luminance from being generated as the organic light emitting diode (OLED) deteriorates. Also, the timing controller 150 generates a second data (Data2) so that it can compensate for threshold voltage and/or mobility variation of the second transistor (M2) with reference to the first digital value and the second digital value, and therefore the timing controller 150 may display an image having a uniform luminance regardless of the threshold voltage and/or mobility variation of the second transistor (M2). The information about the threshold voltage and/or mobility of the second transistor (M2) may be obtained using the second digital value or the first digital value.

The first digital value and the second digital value supplied from the ADC 182 may be supplied to the controller 192. The controller 192 may use the first digital value and the second digital value to generate a third digital value including only the information about the threshold voltage and/or mobility of the second transistor (M2). The controller 192 stores the second digital value supplied from the ADC 182; and the generated third digital value in the memory 191. In this case, the second digital value stored in the memory 191 includes the information about the deterioration of the organic light emitting diode (OLED), and the third digital value includes the information about the threshold voltage and/or mobility of the second transistor (M2), and therefore extracting the information about the threshold voltage and/or mobility of the second transistor (M2) from the timing controller 150 may be omitted.

The data driver 120 uses the second data (Data) to generate a data signal and supplies the generated data signal to the pixel 140.

Figure 5:
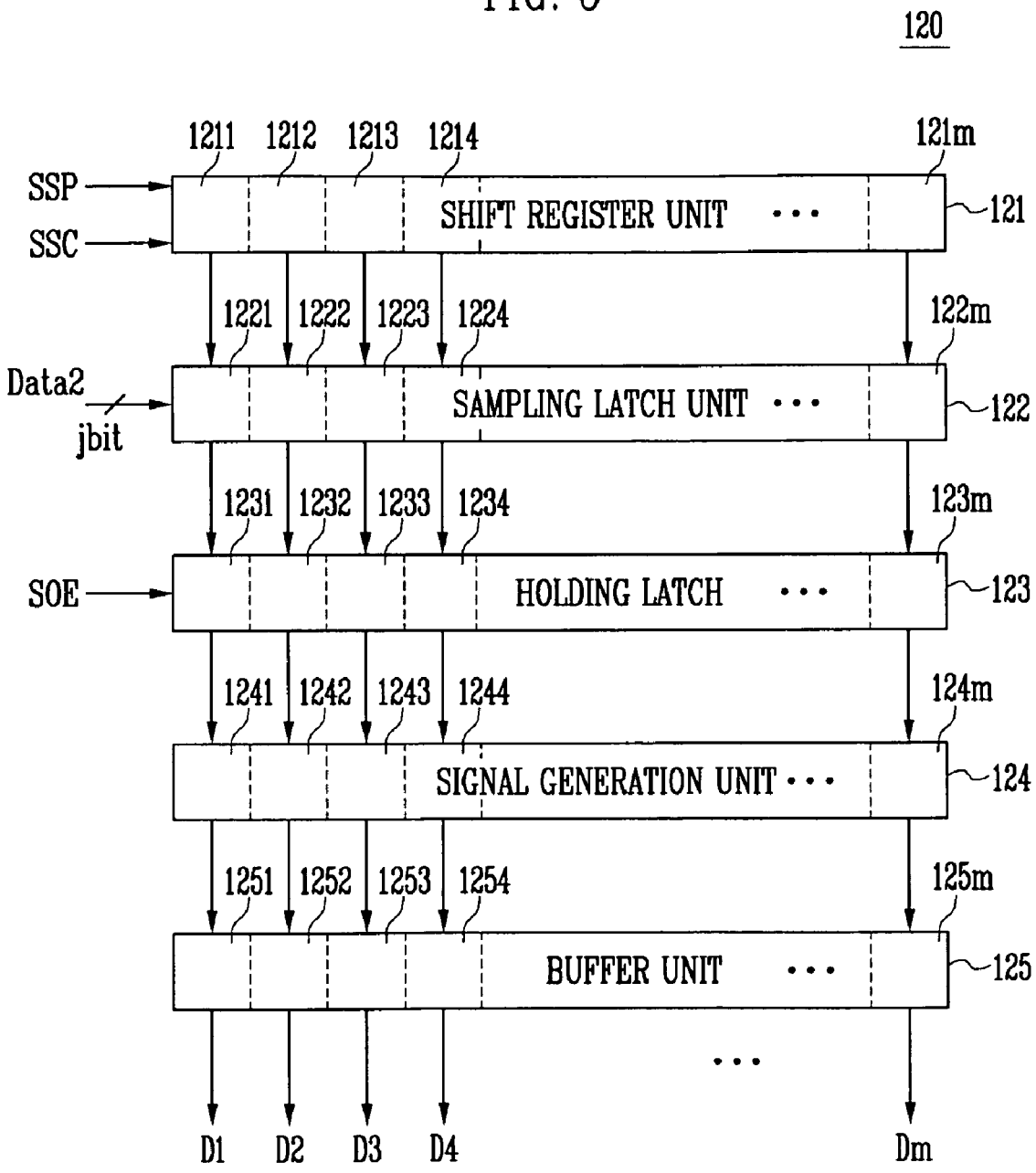
FIG. 5 is a block diagram showing an embodiment of a data driver of FIG. 2.

FIG. 5 is a diagram showing one embodiment of a data driver.

Referring to FIG. 5, the data driver includes a shift register unit 121, a sampling latch unit 122, a holding latch unit 123, a signal generation unit 124 and a buffer unit 125.

The shift register unit 121 receives a source start pulse (SSP) and a source shift clock (SSC) from the timing controller 150. The shift register unit 121 receiving the source shift clock (SSC) and the source start pulse (SSP) sequentially generates the sampling signals while shifting the source start pulse (SSP) during each period of the source shift clock (SSC). For this purpose, the shift register unit 121 includes m shift registers (1211 to 121m). In some embodiments, m is greater than 9.

The sampling latch unit 122 sequentially stores the second data (Data2) in response to the sampling signal sequentially supplied from the shift register unit 121. For this purpose, the sampling latch unit 122 includes the m number of sampling latch 1221 to 122m so as to store the m number of the second data (Data2).

The holding latch unit 123 receives a source output enable (SOE) signal from the timing controller 150. The holding latch unit 123 receiving the source output enable (SOE) signal receives a second data (Data2) from the sampling latch unit 122 and stores the received second data (Data2). The holding latch unit 123 supplies the second data (Data2) stored therein to the signal generation unit 124. For this purpose, the holding latch unit 123 includes the m number of holding latches 1231 to 123m.

The signal generation unit 124 receives second data (Data2) from the holding latch unit 123, and generates the m number of data signals according to the received second data (Data2). For this purpose, the signal generation unit 124 includes the m number of digital-analog converters (hereinafter, referred to as "DAC") 1241 to 124m. That is to say, the signal generation unit 124 uses the DACs (1241 to 124m), arranged in each channel, to generate the m number of data signals and supplies the generated data signals to the buffer unit 125.

The buffer unit 125 supplies the m number of the data signals supplied from the signal generation unit 124 to each of the m number of the data lines (D1 to Dm). For this purpose, the buffer unit 125 includes the m number of buffers (1251 to 125m).

Figure 6A:
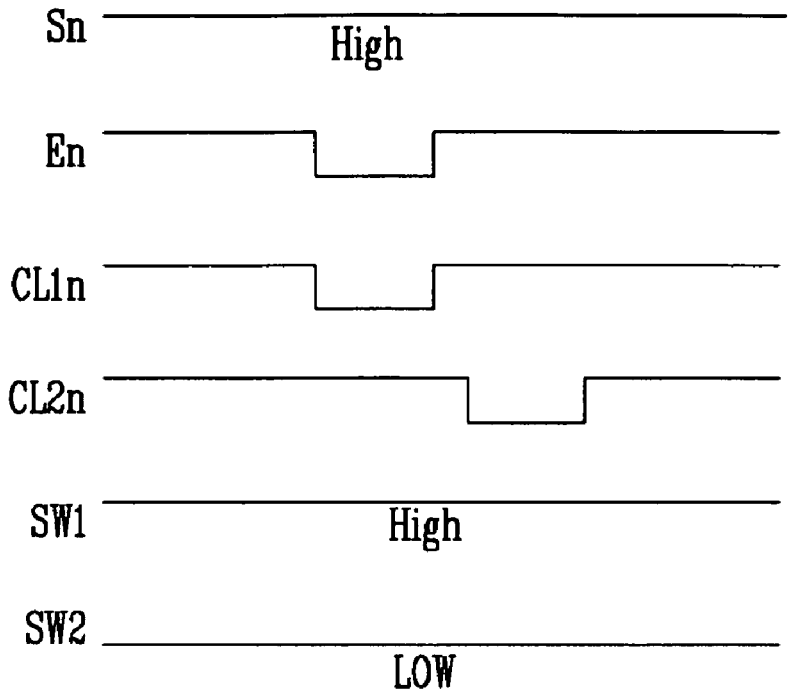
FIG. 6*a* and FIG. 6*b* are waveform views showing a method from driving an organic light emitting display according to one embodiment.
Figure 6B:
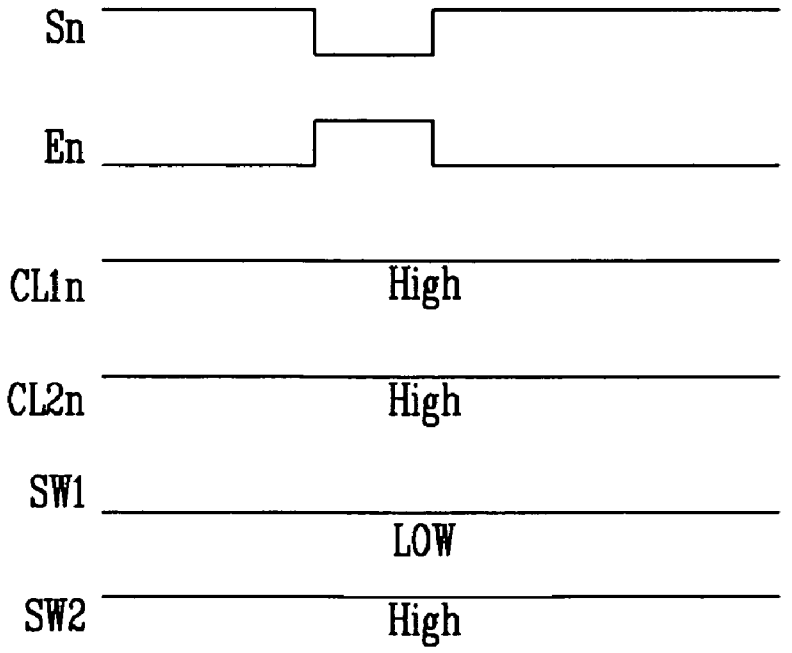

FIG. 6*a* and FIG. 6*b* are timing diagrams showing a driving waveform supplied to the pixel and the switching unit.

FIG. 6*a* shows a waveform for sensing information about the threshold voltage and/or mobility of the second transistor (M2) and the deterioration of the organic light emitting diode (OLED) in the pixels 140. The second switching element (SW2) is maintained in a turned-on state.

Figure 7:
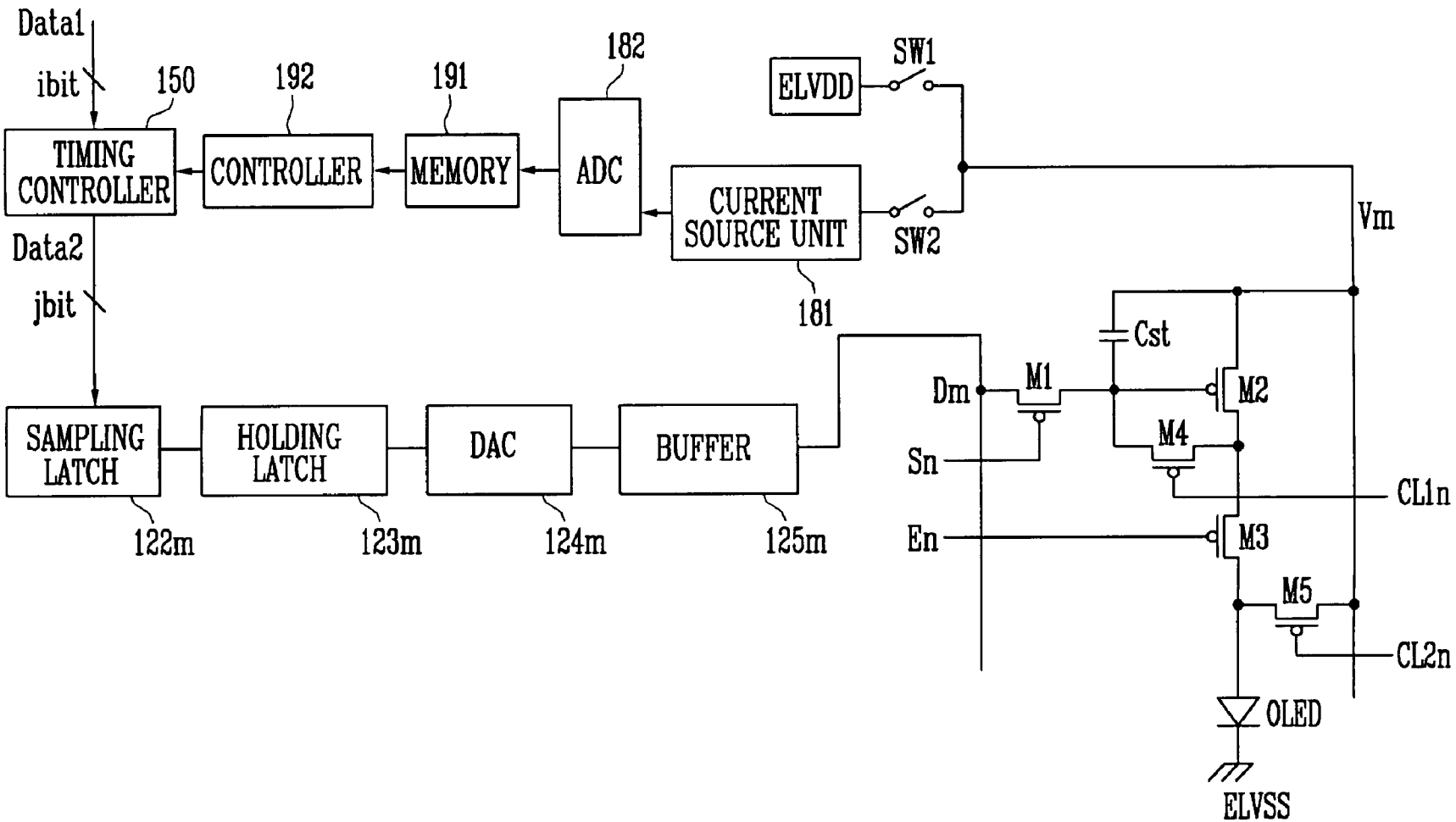
FIG. 7 is a block diagram showing a configuration where a data driver, a timing controller, a control block, a sensing unit, a switching unit and pixels are coupled to each other.

An operation of the organic light emitting display will be described in more detail with reference to FIG. 6*a* and FIG. 7. First, if a first control signal is supplied to the first control line (CL1n), then the fourth transistor (M4) is turned on. And the third transistor (M3) is maintained in a turned-on state since a light emitting control signal is not supplied to the light emitting control line (En). Also, the second switching element (SW2) is maintained in a turned-on state.

When the fourth transistor (M4) is turned on, the second transistor (M2) is coupled in a diode configuration. As a result, an electric current is supplied from the electric current source unit 181 to the second power source (ELVSS) through the second transistor (M2), the third transistor (M3), and the organic light emitting diode (OLED). As a result, a first voltage is generated according to the electric current flowing in the electric current source unit 181. For example, the first voltage is the result of a combination of the threshold and/or mobility of the second transistor (M2) and the resistance of the organic light emitting diode (OLED), showing the deterioration thereof. As described above, the first voltage applied to the electric current source unit 181 is converted into a first digital value in the ADC 182, and the converted first digital value is then supplied to the memory 191, and therefore a first digital value is stored in the memory 191.

To characterize the organic light emitting diode (OLED) without the second transistor (M2), the supply of the first control signal to the first control line (CL1n) is suspended, and the light emitting control signal is supplied to the light emitting control line (En). As a result, the fourth transistor (M4), and the third transistor (M3) are turned off.

After the fourth transistor (M4) and the third transistor (M3) are turned off, the second control signal is supplied to the second control line (CL2n), and the fifth transistor (M5) is turned on.

Once the fifth transistor (M5) is turned on, the constant electric current supplied from the electric current source unit 181 is supplied to the second power source (ELVSS) through the fifth transistor (M5) and the organic light emitting diode (OLED). As a result, a second voltage is generated according to the constant electric current flowing in the electric current source unit 181 applied to the organic light emitting diode (OLED). The second voltage applied to the electric current source unit 181 is converted into a second digital value in the ADC 182 and the converted second digital value is supplied to the memory 191, and therefore the second digital value is stored in the memory 191.

The first digital value and the second digital value corresponding to each of all the pixels 140 are stored in the memory 191 through the procedure as described above. Furthermore, the procedure of sensing the information about the threshold voltage and/or mobility of the second transistor (M2) and the deterioration of the organic light emitting diode (OLED) may be carried out, for example, whenever power is supplied to the organic light emitting display.

The first digital value and the second digital value generated in the ADC 182 may be supplied to the controller 192. In this case, the controller 192 converts the first digital value so that it can have the information about the threshold voltage and/or mobility of the second transistor (M2), and then stores the converted first digital value in the memory 191.

FIG. 6*b* shows a waveform view for carrying out a normal display operation.

During a normal display period, the scan driver 110 sequentially supplies a scan signal to the scan lines (S1 to Sn), and sequentially supplies a light emitting control signal to the light emitting control lines (E1 to En). The first switching element (SW1) is maintained in a turned-on state during the normal display period. Also, the fourth transistor (M4) and the fifth transistor (M5) are maintained in a turned-off state during the normal display period.

An operation of the organic light emitting display will be described in more detail with reference to FIG. 6*b* and FIG. 7. First, a first data (Data1) is supplied to the timing controller 150. The controller 192 supplies a first digital value and a second digital value to the timing controller 150, the first digital value and the second digital value being extracted from the pixel 140 coupled with the data line (Dm) and the scan line (Sn) as described above.

The timing controller 150 receiving the first digital value and the second digital value convert the first data (Data1) to generate a second data (Data2). The second data (Data2) is set so as to compensate for the deterioration of the organic light emitting diode (OLED) and the threshold voltage and/or mobility of the second transistor (M2).

For example, a "00001110" may be the first data (Data1). The timing controller 150 may generate "000011110" as the second data (Data2) so as to compensate for the deterioration of the organic light emitting diode (OLED) and/or a shift in the threshold voltage and/or mobility of the second transistor (M2).

The second data (Data2) generated in the timing controller 150 is supplied to a DAC 124m via a sampling latch 122m and a holding latch 123m. The DAC 124m then uses the second data (Data2) to generate a data signal, and supplies the generated data signal to the data line (Dm) via a buffer 125m.

Because the first transistor (M1) is turned on if the scan signal is supplied to the scan line (Sn), the data signal supplied to the data line (Dm) is supplied to the gate electrode of the second transistor (M2). The storage capacitor (Cst) is charged with a voltage corresponding to the data signal. The third transistor (M3) is turned off by the light emitting control signal supplied from the light emitting control line (En) during a period when the voltage corresponding to the data signal is charged in the storage capacitor (Cst), and therefore the supply of unnecessary current to the organic light emitting diode (OLED) may be prevented.

The first transistor (M1) is turned off when the supply of the scan signal is suspended, and the third transistor (M3) is turned on when the supply of the light emitting control signal is suspended. The second transistor (M2) supplies an electric current to the organic light emitting diode (OLED), where the electric current corresponds to the voltage charged in the storage capacitor (Cst). As a result, the organic light emitting diode (OLED) generates light having a luminance corresponding to the supplied electric current.

The electric current supplied to the organic light emitting diode (OLED) is set so as to compensate for the deterioration of the organic light emitting diode (OLED) and the threshold voltage and/or mobility of the second transistor (M2), and therefore the electric current may be used to uniformly display an image having a desired luminance.

The pixel 140 as shown in FIG. 3 is configured with PMOS transistors, but the present invention is not limited thereto. The pixels 140 as shown in FIG. 3 may be configured with NMOS transistors. In this case, polarity of a driving waveform of the NMOS transistors is set to a polarity that is opposite to the polarity of the PNMOS transistors, as is well known in the art.

As described above, the organic light emitting display and the driving method thereof stores information about the threshold voltage and/or mobility of the drive transistor and the deterioration of the organic light emitting diode in a memory. The organic light emitting display generates a second data to compensate for the deterioration of the organic light emitting diode and the threshold voltage and/or mobility of the drive transistor using the information stored in the memory; and supplies the generated second data signal to the pixels. As a result, the organic light emitting display displays an image having a uniform luminance regardless of the deterioration of the organic light emitting diode and the threshold voltage and/or mobility of the drive transistor.

Although exemplary embodiments of the present invention have been shown and described, it would be appreciated by those skilled in the art that changes might be made in these embodiments without departing from the principles and spirit of the invention.

What is claimed is:

1. An organic light emitting display, comprising:

a plurality of pixels, each arranged near intersections of data lines, scan lines, power lines and light emitting control lines;

a scan driver configured to supply a scan signal to the scan lines and to supply a light emitting control signal to the light emitting control lines;

a control line driver configured to supply a first control signal to first control lines and to supply a second control signal to second control lines;

a data driver configured to generate a data signal for the data lines;

a sensing unit configured to sense information about at least one of an organic light emitting diode, a threshold voltage of a drive transistor, and mobility of the drive transistor for one or more of the pixels;

a switching unit configured to couple one of the sensing unit and the first power source with the power lines;

a control block configured to store the sensed information; and a timing controller configured to generate the second data based on the sensed information and a first data received from another circuit, wherein the sensing unit comprises:

an electric current source unit in each of a plurality of channels; and an analog-digital converter configured to convert sensed information about deterioration of the organic light emitting diode and threshold voltage and/or mobility of the drive transistor into a first digital value and to convert information about deterioration of the organic light emitting diode into a second digital value.

2. The organic light emitting display according to claim 1, wherein the switching unit includes two switching elements in each channel, and the two switching elements comprise:

a first switching element between the first power source and one of the power lines, the first switching element configured to be turned on when the first power source is supplied to the power line; and a second switching element between the electric current source unit and the one power line, the second switching element configured to be turned on when the information is sensed.

3. The organic light emitting display according to claim 2, wherein the control block comprises:

a memory configured to store the first digital value and the second digital value; and a controller configured to transmit the first digital value and the second digital value to the timing controller.

4. The organic light emitting display according to claim 3, wherein the controller is configured to transmit the first digital value and the second digital value to the timing controller when the first data is input to the timing controller.

5. The organic light emitting display according to claim 4, wherein the timing controller is configured to generate the second data using the first digital value and the second digital value and the second data has more bits than the first data.

6. The organic light emitting display according to claim 5, wherein the second data has a value which compensates for at least one of deterioration of the organic light emitting diode, threshold voltage variation of the drive transistor, and mobility variation of the drive transistor.

7. The organic light emitting display according to claim 3, wherein each of the pixels comprises:

an organic light emitting diode;

a first transistor coupled to the scan lines and the data lines and configured to be turned on when a scan signal is supplied to the scan lines;

a storage capacitor configured to be charged with a voltage corresponding to the data signal supplied to the data lines;

a drive transistor configured to supply an electric current to the organic light emitting diode according to the voltage stored in the storage capacitor;

a third transistor between the drive transistor and the organic light emitting diode configured to be turned off when a light emitting control signal is supplied to the light emitting control line;

a fourth transistor coupled between a gate electrode and a second electrode of the drive transistor and turned on when a first control signal is supplied to the first control line; and a fifth transistor arranged between an anode electrode of the organic light emitting diode and the power line and configured to be turned on when a second control signal is supplied to the second control line.

8. The organic light emitting display according to claim 7, wherein, when the information is sensed, the fourth transistor and the third transistor are turned on to allow an electric current, supplied from the electric current source unit, to flow in the drive transistor and the organic light emitting diode.

9. The organic light emitting display according to claim 8, wherein a first voltage, generated when the electric current flows in the drive transistor and the organic light emitting diode, is converted into the first digital value.

10. The organic light emitting display according to claim 8, wherein, when the information about deterioration of the organic light emitting diode is sensed, the fifth transistor is turned on to allow the constant electric current, supplied from the electric current source unit, to flow in the organic light emitting diode.

11. The organic light emitting display according to claim 10, wherein a second voltage, generated when the constant electric current flows in the organic light emitting diode, is converted into the second digital value.

12. The organic light emitting display according to claim 11, wherein the first digital value and the second digital value are generated when a power source is supplied to the organic light emitting display.

13. The organic light emitting display according to claim 7, wherein the fourth transistor and fifth transistor are maintained in a turned-off state during a period when a data signal is supplied to the storage capacitor and during a period when light is generated in the organic light emitting diode.

14. The organic light emitting display according to claim 5, wherein the data driver comprises:

a shift register unit configured to sequentially generate a sampling signal;

a sampling latch unit configured to sequentially store the second data according to the sampling signal;

a holding latch unit configured to temporarily store the second data stored in the sampling latch unit;

a signal generation unit configured to generate data signals using the second data stored in the holding latch unit; and a buffer unit configured to transmit the data signals to the data lines.

15. The organic light emitting display according to claim 2, wherein the control block comprises:

a controller configured to generate a third digital value having only information about at least one of threshold voltage and mobility of the drive transistor using the first digital value and the second digital value; and a memory configured to store the second digital value and the third digital value.

16. The organic light emitting display according to claim 15, wherein the timing controller is configured to generate the second data using the second digital value and a third digital value, wherein the second data comprises more bits than the first data.

17. The organic light emitting display according to claim 16, wherein the second data has a value which compensates for at least one of deterioration of the organic light emitting diode, threshold voltage variation of the drive transistor, and mobility variation of the drive transistor.

18. A method of driving an organic light emitting display, the method comprising:

generating a first voltage while supplying an electric current to a drive transistor and an organic light emitting diode;

converting the first voltage into a first digital value and storing the first digital value in a memory;

generating a second voltage while supplying an electric current to the organic light emitting diode;

converting the second voltage into a second digital value and storing the second digital value in the memory; and converting a first data supplied from another circuit to a second data based on the first digital value and the second digital value, wherein the first digital value and the second digital value are generated when a power source is supplied to the organic light emitting display.

* * * * *